US006220599B1

(12) United States Patent
Eisch

(10) Patent No.: US 6,220,599 B1
(45) Date of Patent: Apr. 24, 2001

(54) DIVE STICK USED IN AQUATIC GAMES

(75) Inventor: James P. Eisch, Tampa, FL (US)

(73) Assignee: Florida Pool Products, Inc., Clearwater, FL (US)

( * ) Notice: Subject to any disclaimer, the term of this patent is extended or adjusted under 35 U.S.C. 154(b) by 0 days.

(21) Appl. No.: 09/501,429

(22) Filed: Feb. 10, 2000

(51) Int. Cl.[7] ..... A63B 67/00
(52) U.S. Cl. ..... 273/457; 273/440; 446/153
(58) Field of Search ..... 273/440, 447, 273/459; 446/153, 155, 160, 161; 472/128; 434/254; 224/934; 220/890, DIG. 13; D21/311, 815, 801

(56) References Cited

U.S. PATENT DOCUMENTS

| | | | | |
|---|---|---|---|---|
| 1,675,522 | | 7/1928 | Weidinger et al. . | |
| 2,191,150 | * | 2/1940 | Abell | 273/457 X |
| 2,752,725 | * | 7/1956 | Unsworth | 273/457 X |
| 3,183,002 | | 5/1965 | Updaw . | |
| 3,586,323 | * | 6/1971 | Carter | 273/440 |
| 4,515,572 | | 5/1985 | Emms . | |
| 5,009,413 | * | 4/1991 | Allen | 273/440 X |
| 5,356,132 | * | 10/1994 | McEwan et al. | 473/411 |
| 5,722,871 | | 3/1998 | Zamir . | |
| 5,928,053 | | 7/1999 | Henderson . | |
| 6,093,076 | * | 7/2000 | Street | 446/156 |

* cited by examiner

*Primary Examiner*—Raleigh W. Chiu
(74) *Attorney, Agent, or Firm*—Larson & Larson, P.A.; James E. Larson

(57) ABSTRACT

The dive stick is a one piece molded flexible polymer having four elongated wings joined at a common edge at right angles to each other. An enclosure is molded to one end of the four elongated wings and a first shelf is molded to the opposite end. A second shelf is parallel and spaced apart from the first shelf. In a first game, one or more dive sticks are thrown into a pool. Different players are timed to determine who can retrieve the dive sticks the fastest. A second game is played by dropping a dive stick at one end of the pool and having a race to see who can retrieve a dive stick and return to his/her side of the pool the fastest.

5 Claims, 7 Drawing Sheets

DIVE STICK USED IN AQUATIC GAMES

FIELD OF THE INVENTION

The present invention relates to a device for playing aquatic games. More particularly, it refers to a polymeric flexible dive stick for use in pool games.

DESCRIPTION OF THE PRIOR ART

Pool toys are generally well known as seen in U.S. Pat. Nos. 1,675,522; 3,183,002; 4,515,572; 5,722,871; and 5,928,053. In addition, heavier than water objects have commonly been thrown into pools and various games revolving around the retrieval of such objects from the bottom of the pool are well known. Some of these heavy objects can cause injury to players. A dive stick is needed that is player friendly, has the ability to sink and can either lie flat or stand upright in the bottom of a pool.

SUMMARY OF THE INVENTION

I have invented a dive stick that is made from a one-piece flexible molded polymer such as polyvinyl chloride. The dive stick has a top enclosure that can be empty to allow the dive stick to stand upright in the bottom of a pool or be filled with water to permit the dive stick to rapidly sink and lie flat on a pool bottom. Elongated fins and a bottom pair of parallel shelves promote sinking. One or more dive sticks are thrown into a pool to play various pool games.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
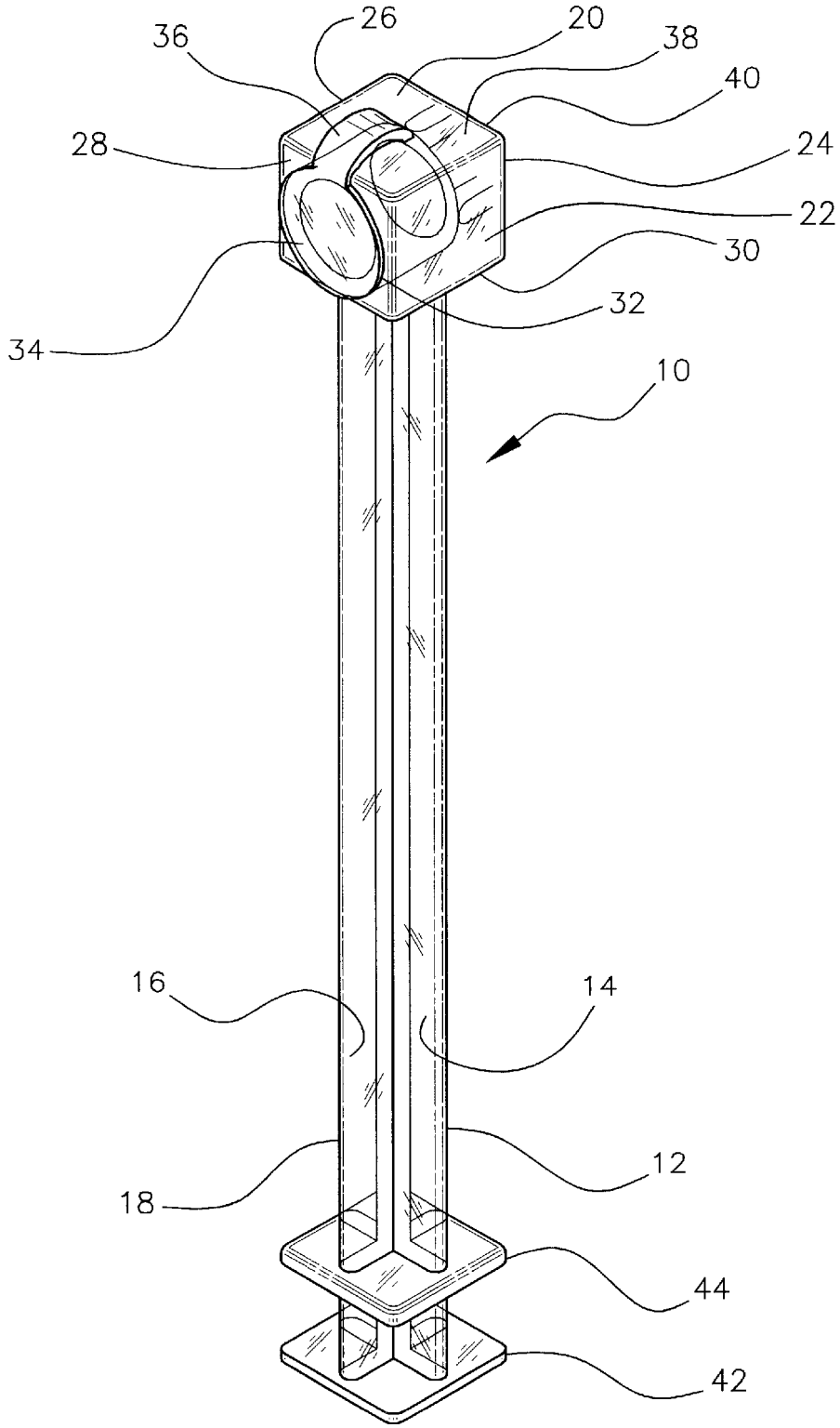
FIG. 1 is a perspective view of the dive stick with the cap closed.
Figure 2:
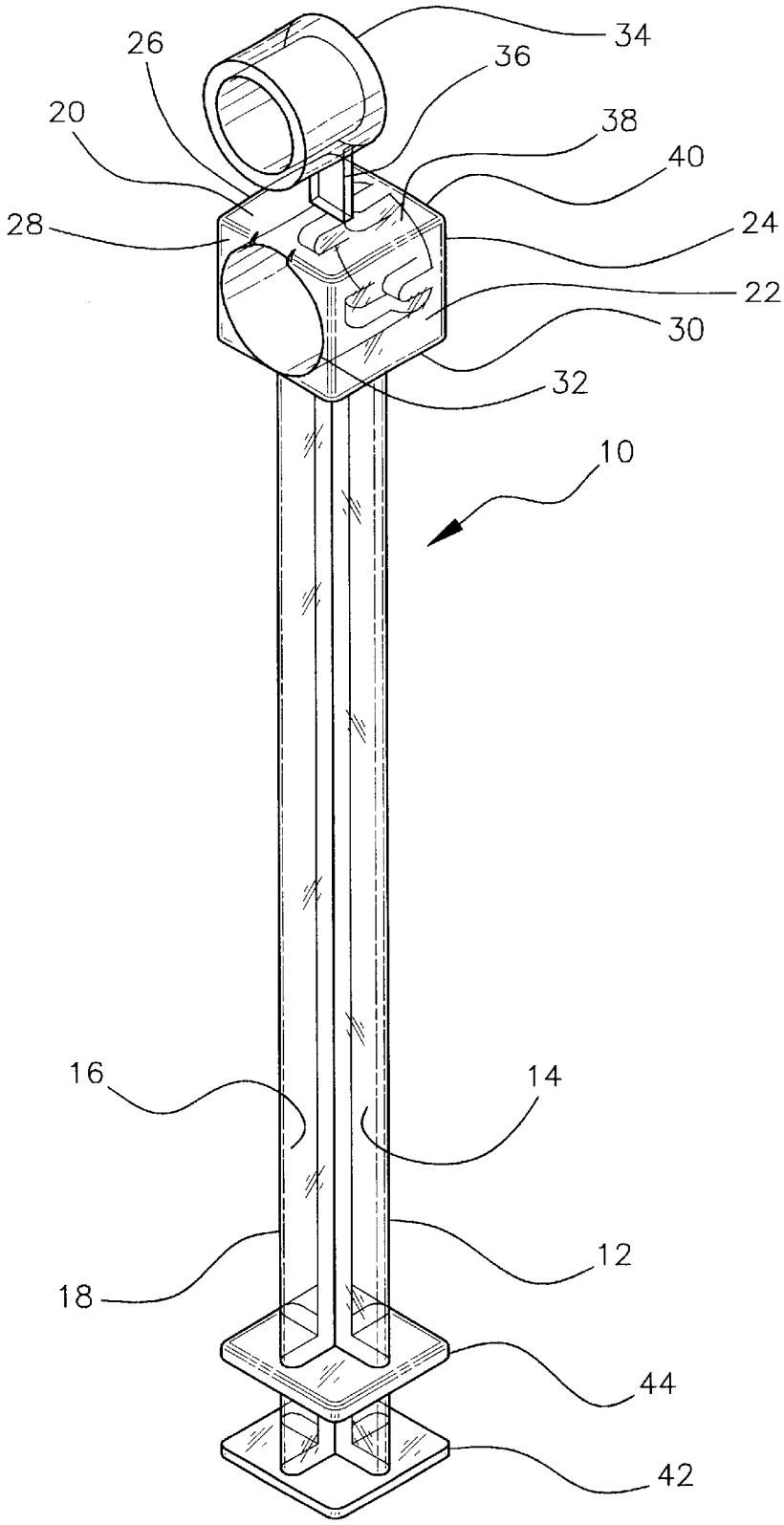
FIG. 2 is a perspective view of the dive stick with the cap open.
Figure 3:
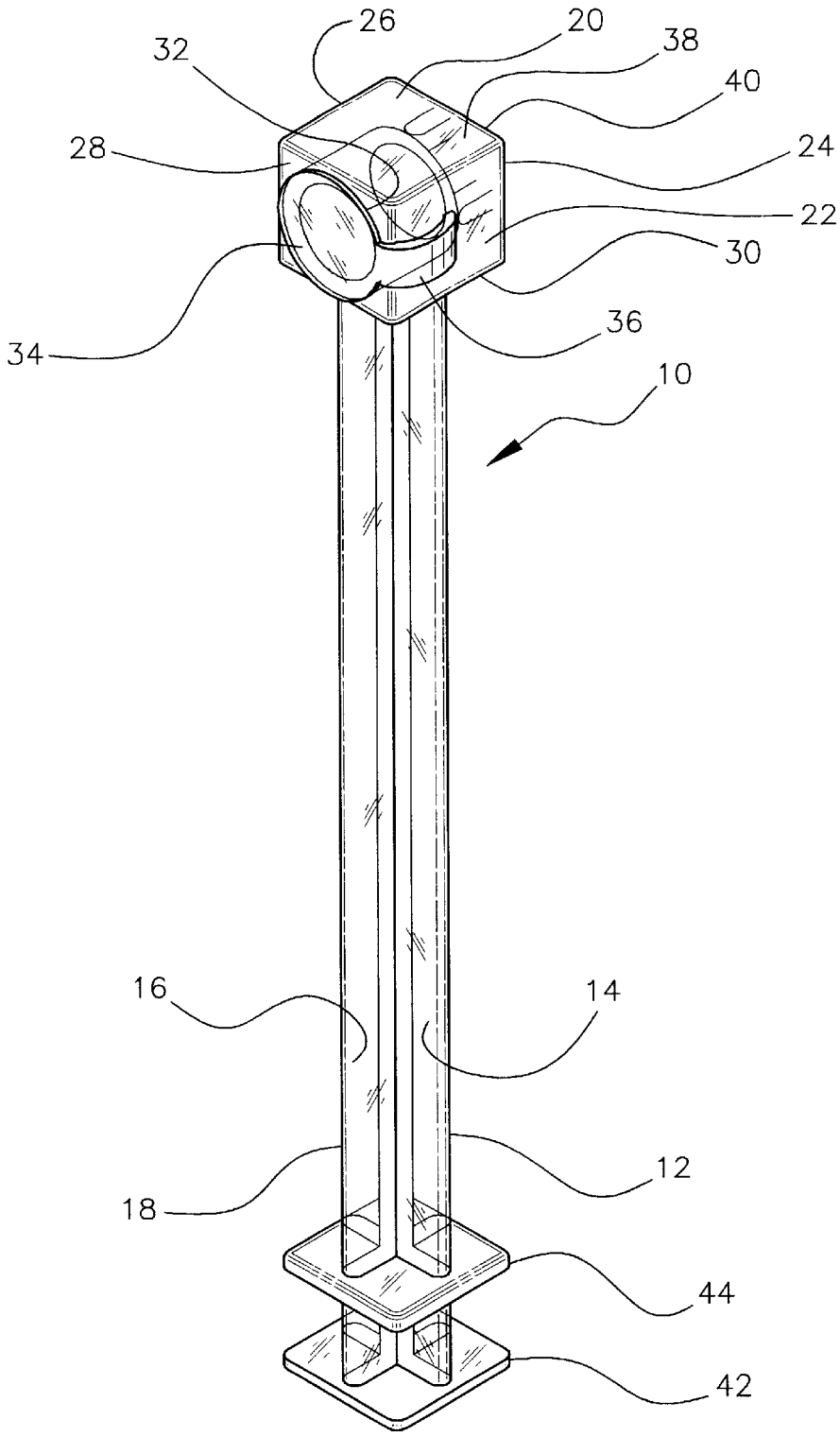
FIG. 3 is a perspective view of the dive stick with the hinge located between a side wall and front wall.
Figure 4:
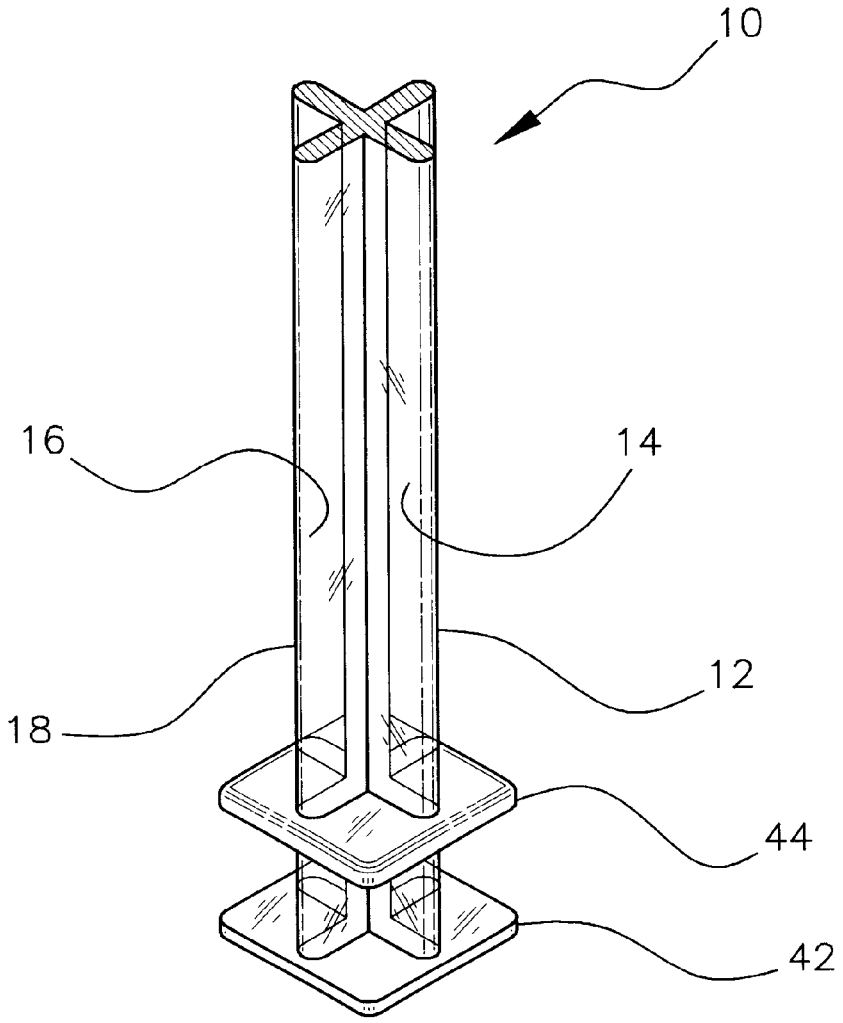
FIG. 4 is a partial cross-sectional view of the dive stick.
Figure 5:
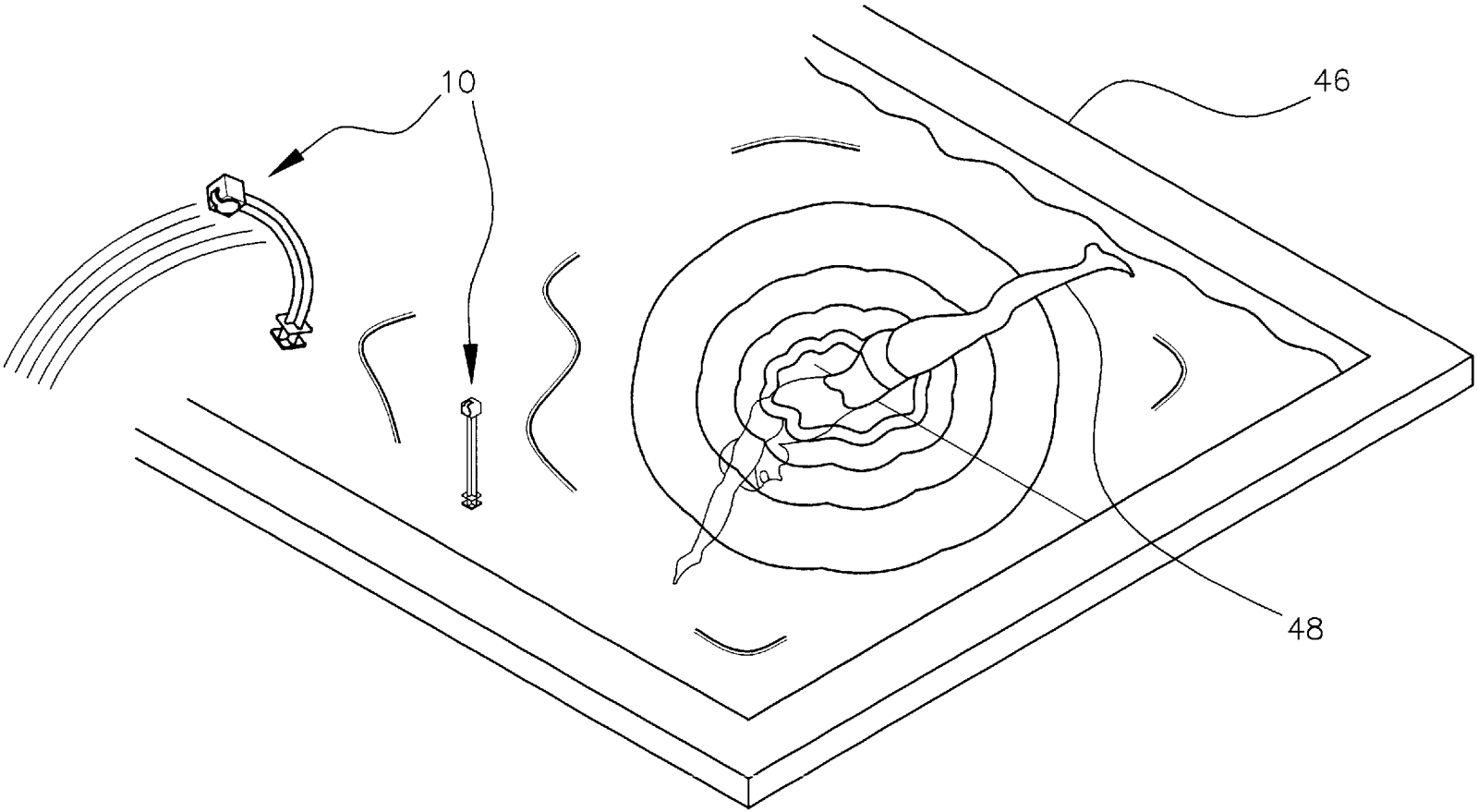
FIG. 5 is a view of the second player diving into a pool to retrieve a dick stick.
Figure 6:
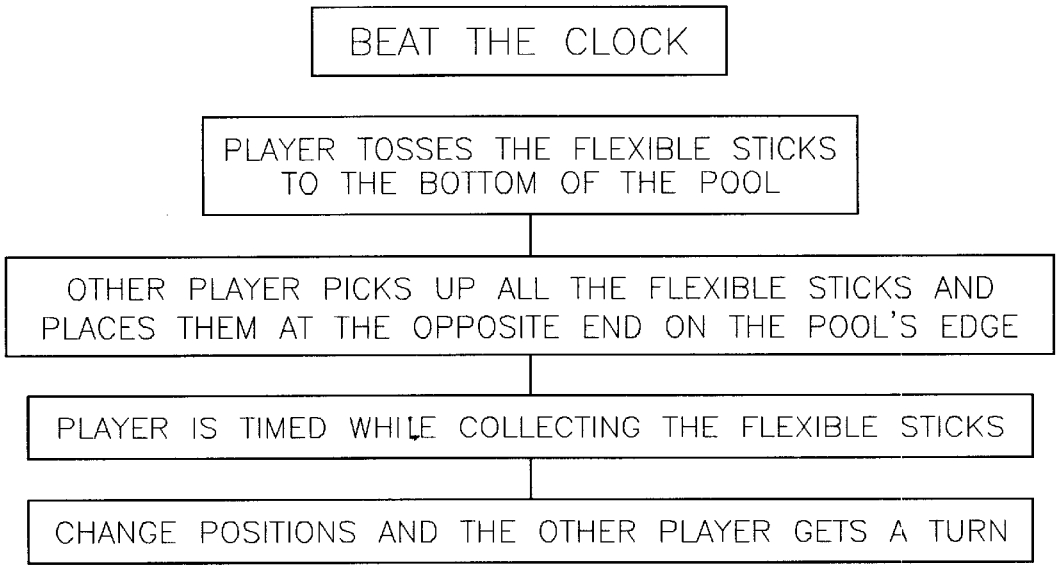
FIG. 6 is a block diagram of the Beat The Clock game.
Figure 7:
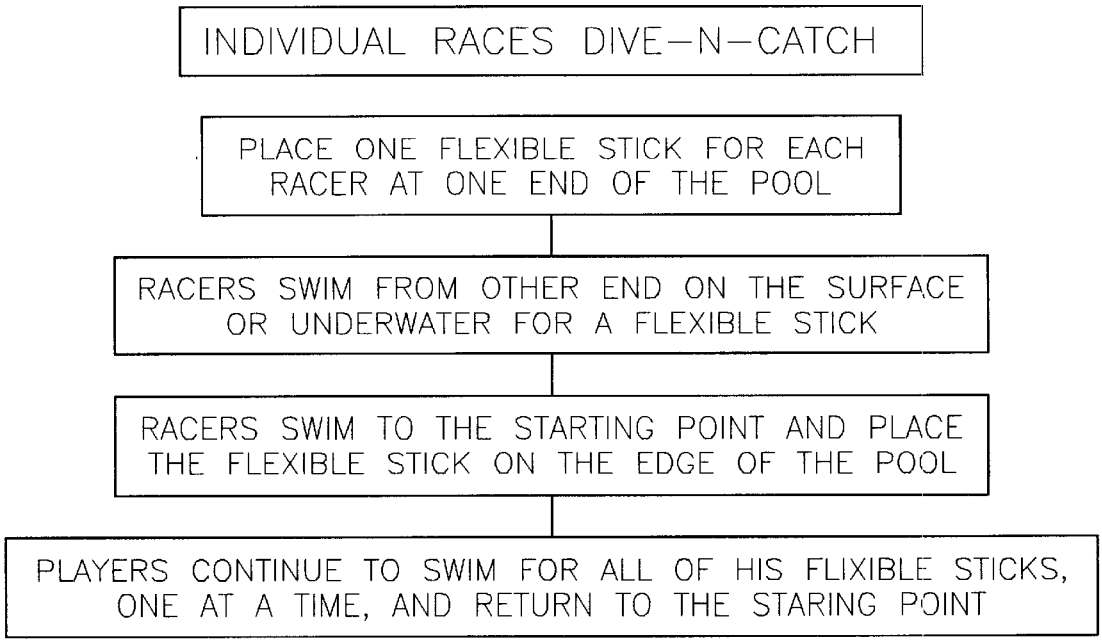
FIG. 7 is a block diagram of the Individual Races Dive-N-Catch game.
Figure 8:
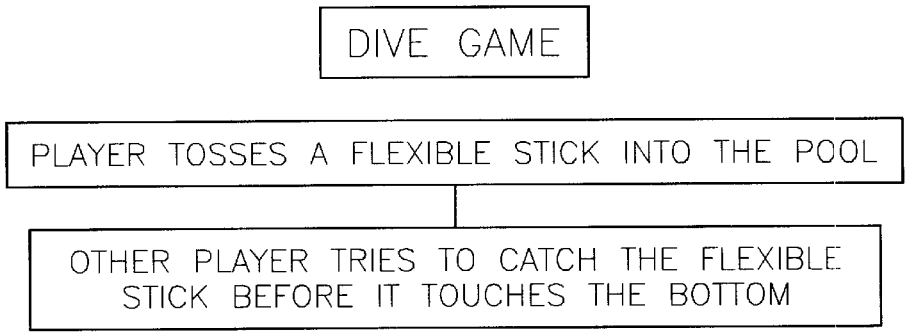
FIG. 8 is a block diagram of the Dive Game.
Figure 9:
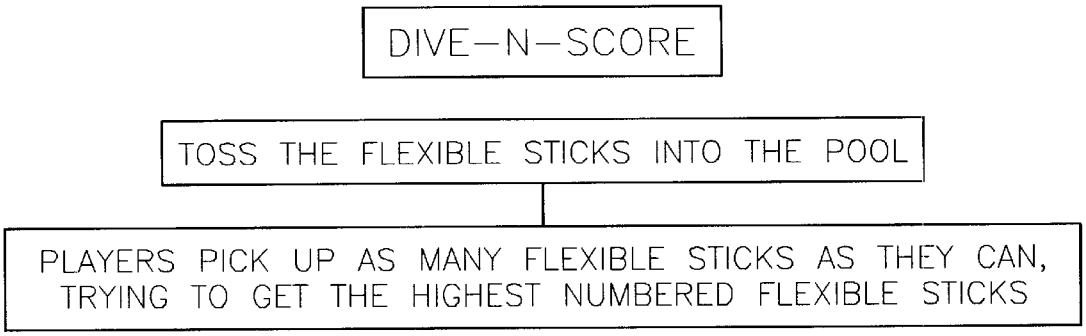
FIG. 9 is a block diagram of the Dive-N-Score game.

Throughout the following detailed description, the same reference numerals refer to the same elements in all figures.

The dive stick 10 shown in FIG. 1 has four elongated integral wings 12, 14, 16 and 18 joined at right angles to each other at a common edge. The top of the four elongated wings is integrally molded to a base 30 of an enclosure 40. The enclosure 40 additionally has a top wall 20 and four side walls 22, 24, 26 and 28. One wall 28 has an opening 32 closed by a plug 34 molded with a flexible hinge 36 to top wall 20.

The enclosure 40 has a hollow interior 38 that remains empty so the dive stick 10 will stand upright in the bottom of a pool or is filled with water so the dive stick 10 will lie flat at the bottom of the pool.

A first shelf 42 is molded to a bottom of the four elongated wings. A second shelf 44 is spaced apart and parallel to shelf 42.

The dive stick 10 is made from polyvinyl chloride and is usually molded as a single flexible unit about eighteen centimeters in length. The enclosure 40 has a diameter of about two centimeters. Other suitable flexible polymers can be substituted for the polyvinyl chloride polymer.

Many pool games can be played with dive stick 10. The following games I–IV are preferred games.

Game I

Beat the Clock

Player one tosses several flexible dive sticks 10 to the bottom of a pool 46 from one end. The enclosure 40 of each dive stick 10 in this game is filled with water. Player two 48 dives to the bottom of the pool and retrieves the dive sticks and returns to the opposite end of the pool. The time it takes player two to dive into the pool, retrieve all the dive sticks and return to his/her end of the pool is recorded. Player two then throws the dive sticks into the pool and player one is timed for diving into the pool, retrieving the dive sticks and returning them to his/her side of the pool. The fastest time is the winner.

Game II

Dive-N-Catch

Players one and two drop a dive stick at his/her end of a pool. The dive stick enclosure contains air. Each player simultaneously dives into the pool, retrieves the dive stick on the opposite side and returns to his/her side of the pool. The fastest time is the winner. Multiple dive sticks can be employed to lengthen the contest.

Game III

Dive Game

Player one tosses a dive stick with its enclosure filled with water into the pool. Player two attempts to catch the dive stick before it hits the bottom of the pool. Multiple dive sticks can be thrown. The player who catches the most sticks before they hit the pool bottom is the winner.

Game IV

Dive-N-Score

Players position themselves at opposite ends of a pool. A scorer throws multiple dive sticks containing water in the enclosure into the pool, usually about six, and each player attempts to retrieve as many as possible. The player who retrieves the most is the winner.

As such, an invention has been disclosed in terms of a preferred embodiment which fulfills each and every concept of the invention and provides a new and useful dive stick for use in aquatic games.

Of course, various changes, modifications and alterations in the teachings of the present invention can be contemplated by those skilled in the art without departing from the intended spirit and scope thereof Having described the invention what is claimed is:

1. A flexible polymeric dive stick used in aquatic games, the dive stick comprising:

four elongated wings at right angles to each other, all four integral along one common edge, a top enclosure having a top wall, four side walls and a base molded together as an integral entity, the enclosure molded by its base to one end of the four elongated wings, one wall having an opening closed by a plug integral with one end of a flexible hinge, a second end of the hinge molded to another wall of the enclosure, a first shelf molded to an opposite end of the four elongated wings, and a second shelf parallel and spaced apart from the first shelf, but proximal to the first shelf between the first shelf and the top enclosure, the dive stick sinking after being thrown into a pool to lie flat on a pool bottom when the enclosure is filled with water and standing upright on the pool bottom when empty while playing an aquatic game.

2. A flexible polymeric dive stick according to claim 1 wherein the dive stick is about eighteen centimeters in length and about two centimeters in diameter.

3. A method of playing a pool game comprising:

(a) providing a flexible polymeric dive stick, the dive stick having four elongated wings at right angles to each other along one common edge, a hollow enclosure molded to one end of the four wings, a first shelf molded to a second end of the dive stick, a second shelf molded to the four wings spaced apart, parallel and proximal to the first shelf, (b) filling the hollow enclosure with water and plugging an opening to the enclosure with a plug having a hinge molded to the plug at one end and attached to a wall of the enclosure at another end, (c) tossing the flexible polymeric dive stick into the pool, (d) providing at least two players, and (c) timing each player to determine who can retrieve the dive stick from the pool the fastest.

4. A method of playing a pool game according to claim 3, wherein multiple dive sticks are thrown into the pool and the player who retrieves the most is declared the winner.

5. A method of playing a pool game comprising:

(a) providing a flexible molded polymeric dive stick, the dive stick having four elongated wings at right angles to each other along one common edge, a hollow enclosure molded to one end of the four wings, a first shelf molded to a second end of the dive stick, a second shelf molded to the four wings spaced apart, parallel and proximal to the first shelf, (b) dropping one or more flexible polymeric dive sticks on the surface of the pool alongside one edge of the pool adjacent a first player, (c) dropping one or more flexible polymeric dive sticks on the surface of an opposite side of the pool adjacent a second player, and (d) the players diving into the pool to retrieve the dive sticks at the opposite end of the pool and returning to a starting position, the player having the fastest retrieve time declared the winner.

* * * * *